US006155529A

United States Patent [19]

De Carlo

[11] Patent Number: 6,155,529

[45] **Date of Patent: *Dec. 5, 2000**

[54] ADJUSTABLE CHRISTMAS TREE/PLANT STAND

[76] Inventor: Robert A. De Carlo, 2611 Arbor Creek Way, Hixson, Tenn. 37343

[ * ] Notice: Under 35 U.S.C. 154(b), the term of this patent shall be extended for 203 days.

[21] Appl. No.: 08/706,910

[22] Filed: Sep. 3, 1996

[51] Int. Cl.[7] ..... F16M 13/00

[52] U.S. Cl. ..... 248/523; 248/519; 248/527

[58] Field of Search ..... 248/519, 523, 248/524, 527, 528, 188.5

[56] References Cited

U.S. PATENT DOCUMENTS

| | | | |
|---|---|---|---|
| 2,617,617 | 11/1952 | Krastel et al. | 248/519 X |
| 3,350,043 | 10/1967 | Apple | 248/523 X |
| 4,978,098 | 12/1990 | Peckinpaugh | 248/523 |
| 5,131,618 | 7/1992 | Chapin | 248/519 X |
| 5,209,450 | 5/1993 | Grapes | 248/527 X |
| 5,299,381 | 4/1994 | Oldenburg, Jr. | 248/527 X |
| 5,354,031 | 10/1994 | Bilotti | 248/519 |

*Primary Examiner*—Laurie K. Cranmer
*Attorney, Agent, or Firm*—John P. Halvonik

[57] ABSTRACT

A Christmas tree stand of adjustable nature having a platform of planar construction and an opening near the center of the platform is shown and described. Legs in connection with the platform are of adjustable nature and may be varied in length so that the area underneath the platform may be raised to store presents or adjust the height of the tree in relation to the ceiling. Securing means in connection with the opening are used to set the trunk of the tree in place.

3 Claims, 1 Drawing Sheet

ADJUSTABLE CHRISTMAS TREE/PLANT STAND

FIELD AND BACKGROUND OF THE INVENTION

This invention relates to field of tree stands, and in particular to a Christmas tree stand that has a platform for holding the trunk and a series of adjustable legs in connection with the platform in order to vary the distance that the tree is above the floor in order to place presents, etc. beneath the tree and the stand.

It is thought that a Christmas tree stand having a platform to secure the trunk of a tree and having adjustable legs on the platform will allow those who use the tree to adjust the height of the legs in order to provide for presents, etc. that may be stored under the tree stand as is the traditional custom at Christmas time.

PRIOR ART

While there are Christmas tree stands, none that applicant is aware of have adjustable legs that support the platform that holds the trunk at a distance above the floor (or whatever surface the stand is on).

As the stand is adjustable it may be varied to adjust for the height of the Christmas tree in relation to the ceiling or the floor. The platform can be lowered for a tall tree and raised for a smaller tree. Because of this feature it can also be used and produced as a planter in a home or wherever decorative plants are desired. It is believed that such a stand will have the benefit of adjusting to various heights and room sizes along with the added feature of easy watering and gift storage under the tree.

SUMMARY OF THE INVENTION

The Christmas tree stand comprises a platform of relatively planar construction and having an opening near the center in order to support the trunk of a tree, such as Christmas tree within the opening. Securing means in connection with the opening are used to set the trunk of the tree in place. Legs in connection with the platform are of adjustable nature so that they may be adjusted in height so as to vary the height of the platform above the floor or other surface. The legs may be of telescoping nature and should have a securing means in connection with the sections so that the height of each leg can be locked in place and the platform can be varied in height above the floor.

It is an object of the invention to provide a Christmas tree stand that is adjustable in height and is of durable, long lasting construction.

Another object is to provide a stand for supporting trees in an upright position upon a table, floor or other horizontal surface, such stand being adjustable in height so as to provide space beneath the tree for presents beneath the platform.

Another object of the invention is to provide a Christmas tree stand with a platform for support of the trunk of the tree and that can be stored easily with a minimal amount space.

Other objects of the invention will be apparent to those skilled in the art once the invention is shown and described.

DESCRIPTION OF THE PREFERRED EMBODIMENT

Figure 1:
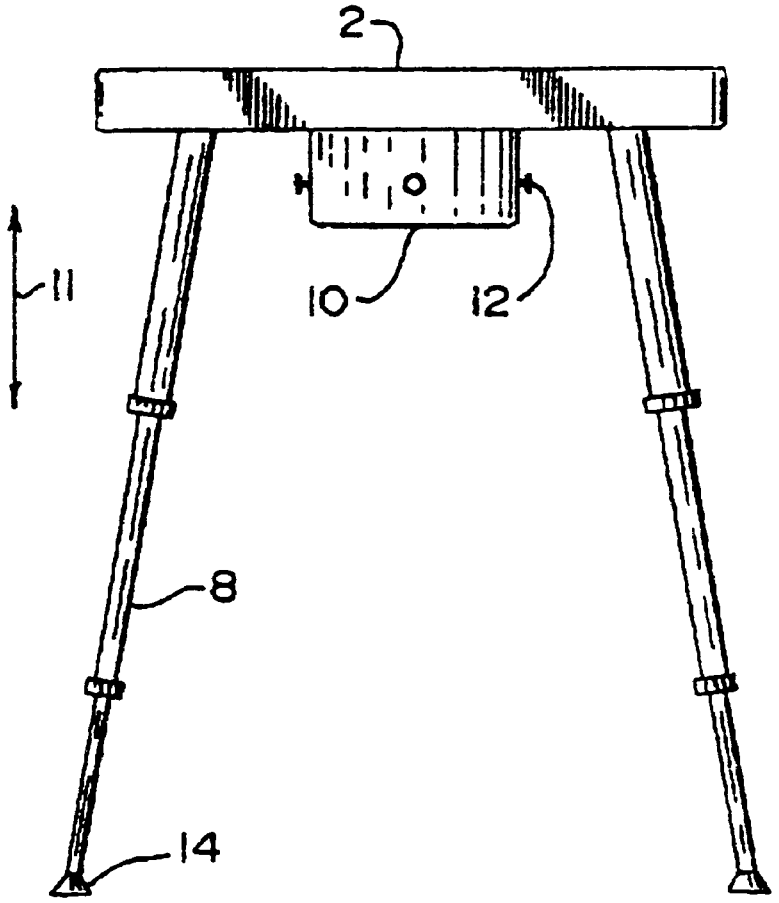
FIG. 1 Side view of stand.
Figure 2:
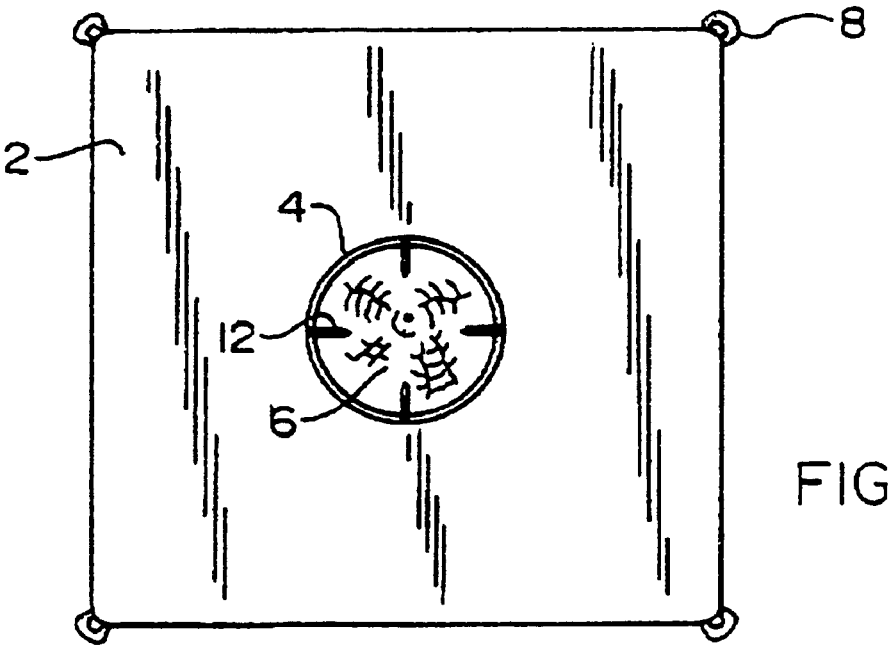
FIG. 2 Top view of stand and trunk.

The top platform 2 of the device has an opening 4 so as to secure the placement of the trunk 6 of a tree, such as a Christmas tree, in an upright position with respect to the floor or other horizontal surface. There may be a cylindrically shaped extension 10, that is in connection with the stand and whose walls are perpendicular to the plane formed by the platform. Such extension may have securing means such as screws 12 or other state of the art means in order to secure the trunk of the tree within this extension portion. The screws may be any state of the art means and are set into the sides of the trunk to secure the trunk within the platform. Such securing means could also be used in direct connection with the platform in order to secure the trunk to the platform.

Legs 8 are connected to the platform and should extend downward in order to support the platform some distance above the floor. The legs may be at or near perpendicular to the plane formed by the platform. It is not necessary that the legs be perpendicular as it is possible that they may be vary somewhat from vertical in order to be more stable.

The legs may be made of telescoping construction so that each leg may be adjusted in height so that they distance of the platform from the floor may be adjusted. The telescoping construction may entail making each leg in sections so that the topmost section of the legs is of larger diameter than that section beneath it, and so forth. In this manner, the legs can be slid within one another so that the overall height of the leg can be varied. Each leg would then have an securing means such as a screw or pin, so that once the height of the leg has been decided upon, the user can then set each leg at this height by turning the screw or otherwise using the securing means.

The diameter of each of the sections of the leg may be round or square and there may be holes in each of the leg sections so that such holes may be lined up with one another and the sections secured to one another in a fixed position by the use of the pins. The attaching means, such as a sturdy fly pin or a bar screw, could be inserted into a pair of holes (one in each section) so that the sections may be fixed at a height that is desired height. It would be easy for the consumer to assemble and very sturdy.

The inside of the legs should be weighted so as to ensure the stability of the device. Such weighted means may be e.g. lead or other heavy material in the bottom portions of the legs. The bottoms of the legs may also be equipped with "feet" 14 in order to minimize damage to rugs or wooden floors. Such feet may be of rubber or other state of the art material and should be able to be attached to the bottom of the leg in order to protect the floor from the effect of the leg rubbing, scraping, etc. against the floor. The feet may also help keep the stand from sliding along the floor.

The stand is used to securely hold a Christmas tree while providing a storage area for gifts directly under the tree. It is preferred that the height of the legs may be adjusted from about 10" to about 32" so that the platform will be supported some distance above the floor.

It is preferred that the platform be of square construction and about 16" along each side. Other shapes are possible without violating the spirit of the invention. It is preferred that the opening in the platform be about 5" in diameter and such opening should be about in the center of the platform. The securing means may be e.g. four screws in connection with the platform so that they may be tightened into the trunk of the tree in order to hold it securely. It is preferred that the components of the stand be constructed of a metal, such as aluminum. Other durable materials may be used without violating the spirit of the invention.

Storage space for this device is minimum, after the telescoping legs have been retracted. The device is easy to set up, and tall enough to prevent children and pets from pulling on the tree. Real or artificial trees could be used in this stand. It can also function as a potted plant holder. This would be useful for hanging plants, as it can raised as the plant grows to allow the plant to hang freely.

In addition, the stand may be used as a plant stand or a floral stand in flower shops, funeral homes, weddings, etc. A tree stand that adjusts to size of the tree and room by adjustment of the legs and thus the height of the platform. The use of such a stand for plants may make for easy watering.

What is claimed is:

1. A Christmas tree stand having adjustable legs comprising:

a platform of planar construction and having at least three legs in connection with said platform, said platform having an opening adapted to accommodate the trunk of the tree, tree securing means in connection with said opening so as to secure said trunk, each of said legs constructed in at least two sections, each of said sections of any one leg of varying diameter so that those sections are adapted to slide within one another, each of said legs having a securing means to secure said sections in relation to one another so that said sections may be adjusted in height by sliding within one another and then locked into place via said securing means so as to vary the height of each leg.

2. The apparatus of claim 1 wherein said sections have a series of apertures in each section, and said tree securing means comprises a pin that is adapted to fit within said apertures and thereby secure said sections in relation to one another.

3. The apparatus of claim 1 wherein said sections have a series of apertures in each section, and said tree securing means comprises a screw that is adapted to fit within said apertures and thereby secure said sections in relation to one another.

* * * * *